United States Patent [19]

Kondur, Jr. et al.

[11] 4,192,618

[45] Mar. 11, 1980

[54] HIGH SPEED TICKET PRINTER

[75] Inventors: Nicholas Kondur, Jr., Riverton, Wyo.; James E. Blomquist, San Antonio, Tex.; Roland R. Rucinski, Riverton, Wyo.

[73] Assignee: LRC, Inc., Riverton, Wyo.

[21] Appl. No.: 957,921

[22] Filed: Nov. 6, 1978

Related U.S. Application Data

[63] Continuation of Ser. No. 782,092, Mar. 28, 1977, abandoned.

[51] Int. Cl.[2] ..... B41J 3/10; B41J 15/16; B41J 11/70

[52] U.S. Cl. ..... 400/124; 101/69; 101/93.05; 226/44; 400/618; 400/621

[58] Field of Search ..... 400/124, 618, 621; 101/93.04, 93.05, 66, 69, 70, 181, 228; 83/341, 349; 226/44

[56] References Cited

U.S. PATENT DOCUMENTS

| | | | |
|---|---|---|---|
| 3,254,626 | 6/1966 | Uemura | 400/119 X |
| 3,329,087 | 7/1967 | Sandor et al. | 101/181 |
| 3,726,212 | 4/1973 | Combs | 101/21 |
| 3,797,389 | 3/1974 | Wolff | 101/228 |
| 3,855,457 | 12/1974 | Amundson et al. | 101/69 X |
| 3,904,011 | 9/1975 | Matschke | 400/124 |
| 3,905,533 | 9/1975 | Corse | 226/44 |
| 3,931,761 | 1/1976 | Carrus et al. | 400/119 X |
| 3,934,695 | 1/1976 | Kovalick | 400/120 |
| 3,956,954 | 5/1976 | Edwards | 83/341 X |
| 4,033,492 | 7/1977 | Imai | 226/44X |

*Primary Examiner*—Paul T. Sewell
*Attorney, Agent, or Firm*—John E. Reilly

[57] ABSTRACT

A matrix printer which is specifically adaptable for printing and the like is characterized by having a stationary print head containing a plurality of print wires which are arranged in a single row extending transversely of the direction of travel of a relatively heavy paper stock. The paper is advanced at a substantially constant rate of speed along the guide path and signals are generated in response to that advancement to activate selected ones of the print wires in the row so as to form dot-like impressions in the paper, line-by-line, as it is advanced past the print head. The density or spacing of the wires coupled with the printing speed is such that designs, alphanumeric characters, together with coded information, may be impressed upon the paper as it is continuously advanced past the print head, the code providing a means of verification of the information printed as well as to signal the end of the printing operation for each ticket. After each ticket is printed, a cutter is activated above the print head to sever the printed portion of the paper from the continuous roll, and an eject mechanism is sequentially activated to direct the severed portion into a discharge area. A loop sensor mechanism is employed in cooperation with a stripper motor to cooperate with the paper advancing means in advancing the paper at a constant rate of speed while minimizing the effects of tension or drag of the paper.

15 Claims, 7 Drawing Figures

HIGH SPEED TICKET PRINTER

This application is a continuation application of Ser. No. 782,097, filed Mar. 28, 1977, and entitled HIGH SPEED TICKET PRINTER, now abandoned.

BACKGROUND AND FIELD OF THE INVENTION

This invention relates to matrix printing apparatus, and more particularly relates to matrix printing apparatus which is specifically adapted for high speed printing of tickets formed from a continuous roll of paper stock.

Customarily, matrix printer apparatus is comprised of a print head having print wires arranged in a column and mounted on a movable carriage to advance along each line of a print medium in forming individual characters, following which the print medium is indexed to the next line as the print head is returned to the margin for printing each next line in succession. The number of print wires is selected according to the height of the characters formed so that as the head is advanced across the paper each character is formed by selectively activating certain of the print wires at closely spaced incremental positions to individually form each character followed by spacing and proceeding to the next character. In the high speed printing of information on a relatively narrow print medium, or in other words, where the margins are relatively close to one another, considerable savings in motion, time and energy may be realized by providing a print head with a sufficient number of print wires to traverse the entire width of the print medium and thereby obviate movement of the print head back and forth across each line to be printed; instead, characters or designs may be formed on the print medium by activating different selected print wires in each line or row as the print medium is advanced in a direction transversely of the row of print wires. Printing in this manner may be best exemplified by reference to its use in the printing of betting tickets for various wagering operations or games of chance in which it is desirable that the tickets be readable both by the customer and by special code readers so that the information printed on each ticket may be verified instantaneously prior to turning over the ticket to the customer.

In order to print tickets in the most rapid, efficient manner, it is highly desirable that the ticket or paper stock be advanced across the print head from a continuous roll; and after each ticket is printed, that means be provided for cutting and ejecting the ticket without interrupting continuous advancement of the paper stock in printing each next ticket in succession. In advancing the paper from the continuous roll, it is necessary to overcome the effects of inertia or drag which tends to increase as the supply roll is reduced in size or diameter. This is especially critical where the stock is to be frictionally advanced at a continuous rate of speed so as to assure uniform spacing between the closely spaced lines of print in forming each character as well as to minimize power requirements both for the paper advancing mechanism and the print wires.

SUMMARY OF THE INVENTION

It is therefore an object of the present invention to provide for a novel and improved wire printing apparatus adaptable for high speed printing of tickets and the like; and wherein a wide variety of information or designs may be printed on the ticket by a stationary print head containing a single row of print wires which is capable of printing designs, alphanumeric characters and codes simultaneously in line-by-line fashion as the ticket stock is advanced past the print head.

It is another object of the present invention to enable continuous advancement of a print medium, such as heavy paper from a continuous supply roll past a print head, to sever the printed portion from the roll at the completion of the printing operation and to eject the severed portion into a separate stacking or discharge area without interruption of the printing operation for each ticket in succession.

It is a further object of the present invention to provide for novel and improved means for advancing a print medium from a continuous supply roll in such a way as to greatly minimize the effects of inertia or drag as the supply roll is reduced in size.

It is an additional object of the present invention to provide a novel and improved print head in which a single row of print wires is arranged in sections or banks wherein the print wires in each section are sequentially fired to form each row or line of print as the print medium is continuously advanced past the print head.

The preferred form of the present invention resides in establishing a guide path for upward travel of a continuous roll of ticket stock past a stationary print head containing a row of print wires disposed transversely of the path of movement of the paper. The print wires are energized in response to signals generated by movement of the paper past a travel sensing mechanism in order to print the dots in each line at an extremely high density and high rate of speed.

In printing tickets from a continuous roll, the information is printed line-by-line by the stationary print head and, at the completion of the last line of print for each ticket, a cutter head is energized to sever the ticket stock beneath the last line of print. An eject mechanism is then energized to advance the severed portion, or ticket, into a stacking area above the cutter head so as to enable separate ejection of each ticket as the paper is continuously advanced upwardly past the print head in printing the next ticket.

In handling relatively heavy paper or ticket stock from a supply roll, a loop sensing mechanism is provided to sense the amount of increasing tension or drag on the paper as it is drawn from the roll in order to activate a motor drive to aid in drawing the paper off of the roll whenever the inertia or tension of the paper increases above a predetermined level. In this way the loop sensor mechanism will assure advancement of the paper at a continuous rate notwithstanding reduction in size of the roll and thereby assure uniform spacing between lines of print. Means also are provided to sense low paper or out-of-paper conditions and to signal the existence of those conditions.

A reversible print ribbon supply mechanism serves to advance the ribbon across the front of the print medium of paper stock at a rate correlated with the printing rate. Both the paper supply roll and print ribbon are readily accessible for replacement.

BRIEF DESCRIPTION OF THE DRAWINGS

With the foregoing and other objects in view, the present invention comprises certain constructions, combinations and arrangements of parts and elements as hereinafter described, defined in the appended claims and illustrated in preferred embodiment by the accompanying drawings in which:

DETAILED DESCRIPTION OF PREFERRED EMBODIMENT

Figure 1:
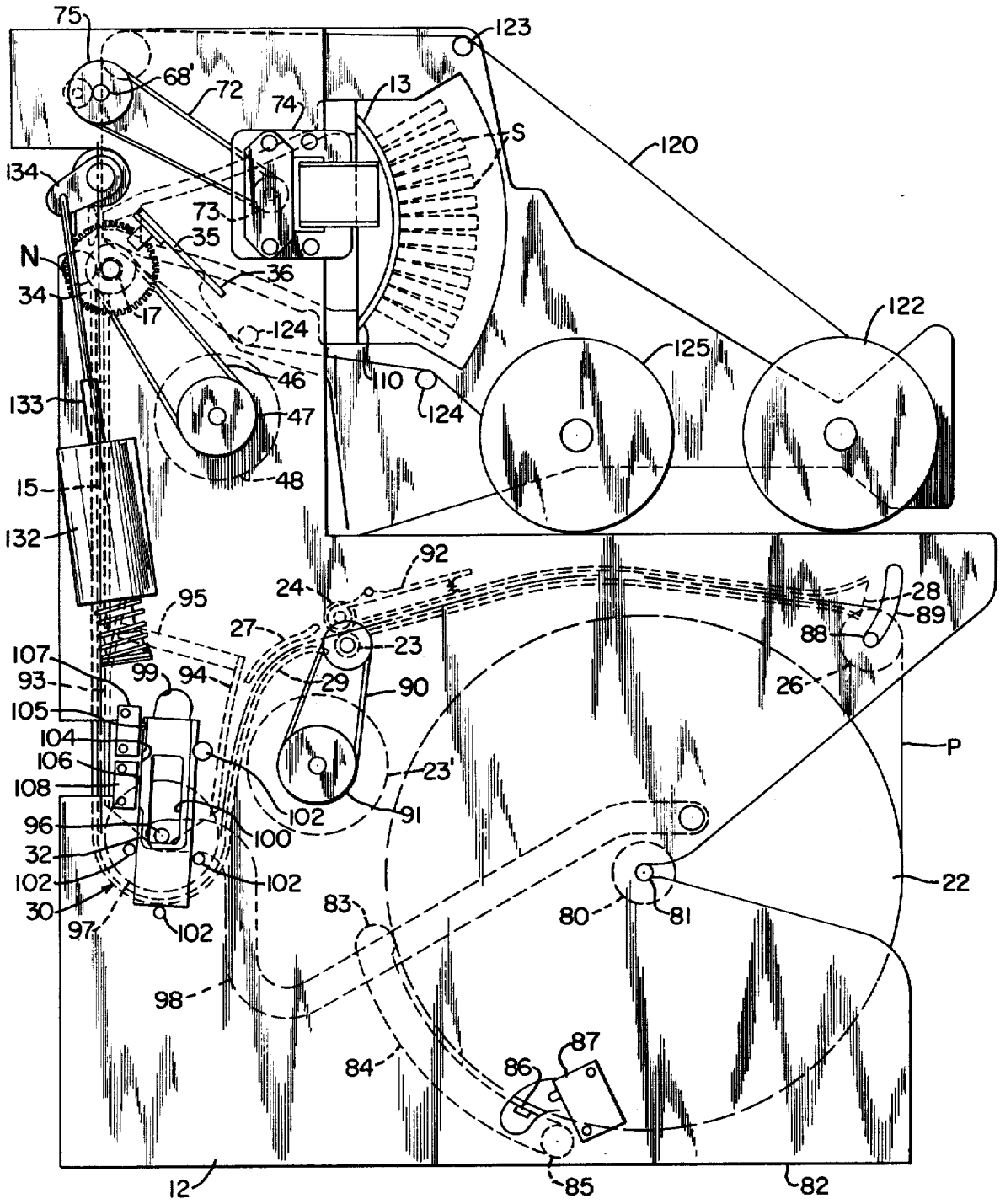
FIG. 1 is a side elevational view of a ticket printer in accordance with the present invention.

The preferred form of ticket printer is broadly comprised of main side frames 12 interconnected in spaced parallel relation to support a print head 13 therebetween. Print head 13 is of the matrix type having print wires W located in facing relation to print bar 14. The print bar presents a rigid printing surface 14' directly opposite to the print head and aligned along the path of movement of a heavy paper stock as represented at P which is advanced upwardly along a guide path 15 between a pressure roller 16 and drive capstan 17. As the paper stock continues upwardly past the print bar it advances through a cutter section designated 18 into a stacking area designated 20. Generally, as printing of each ticket proceeds line-by-line the paper stock will advance continuously past the cutter section; and at the completion of the printing operation for each ticket the paper stock is cut a predetermined number of spaces below the last printed line. The cut portion of the paper or ticket stock is then ejected into the stacking area in a manner to be described and where as represented the tickets T are collected or stacked together on edge at the upper extremity of the printer assembly.

The paper stock is advanced and guided into the printing area off of a paper supply roll 22 by a stripper roll assembly made up of a drive capstan 23 and pressure roller 24 which strips or draws the paper stock upwardly around a guide roller 26 and into an entry guide path designated 28 leading into the stripper roll assembly. From the stripper roll assembly the paper stock is guided by an extension 29 of the entry guide 28 downwardly through a generally U-shaped loop sensor region designated 30 where the paper stock is reversed and caused to continue upwardly along the vertical guide path 15 which is aligned with the drive capstan 17. In a manner to be described, a slider 32 senses the tension in the paper stock and selectively activates the stripper assembly in order to assist in the advancement of the paper into the printing area. In this relation, the paper stock for ticket printing is relatively heavy and due to the intermittent operation of the print head between each ticket to be printed the loop sensor in cooperation with the upper drive capstan 17 and stripper drive 23 permits the paper stock to be advanced at a uniform rate past the print bar.

The rate of advancement of the paper stock is preferably sensed by a timing or strobe disc 34 located on the drive capstan 17 and which in cooperation with an optical switch 35 will sense the rate of advancement of the paper and generate signals to control activation of the print head drive circuit.

The preferred form of print head 13 is of the dot matrix type and comprises three banks of seventeen print wires represented at W arranged in a single row with bar code print wires W' at each end of the row. In a conventional manner, each of the print wires W and W' is driven by a separate solenoid represented at S under the control of a drive circuit represented at 36 which in turn is responsive to signals generated by the optical switching circuit 35 in cooperation with the strobe disc 34. For the purpose of illustration, the strobe disc 34 may be keyed to the capstan drive shaft and has 66 notches represented at N in its outer periphery which in response to rotation of the capstan at the rate of 1.1 inches per revolution will cause passage of six notches or windows on the strobe disc per 1/10th of an inch of linear paper movement; or in other words, one strobe signal is produced for each 0.016 inch of paper movement. Thus as the paper moves each increment, or 0.016 inch, one strobe window passes the strobe reader or optical switch 35 so that every time the drive circuit senses a transition in the strobe electronics will generate a signal for activation of selected print wire solenoids. As indicated previously, the print wires W are preferably arranged in three banks so that when a strobe signal is received selected solenoids S in the first bank of print wires are fired immediately upon recognition of that strobe. After a predetermined time delay, the second bank of solenoids is fired, and after another time delay the third bank of solenoids can be fired. Generally, the time delays are on the order of five hundred microseconds between each bank for the purpose of reducing the power otherwise required to energize a great number of solenoids at one time.

The print wires W' for the bar codes are not printed as often as the print wires W since the bar codes are provided more for the purpose of identification at the beginning and end of each ticket. Thus, for instance the bar codes may be printed at increments of 0.050 inch so as to print a bar code on either side of the ticket to identify the end of or the start of a ticket as well as the other information relating to the ticket.

Figure 2:
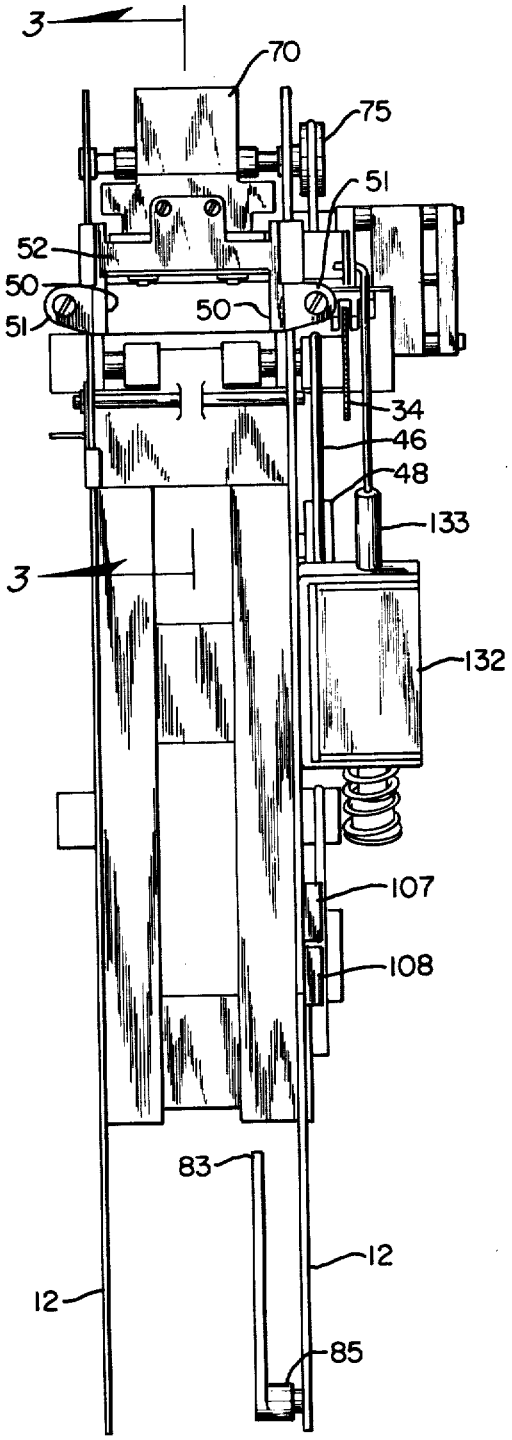
FIG. 2 is a front view of the preferred form of invention shown in FIG. 1.
Figure 3:
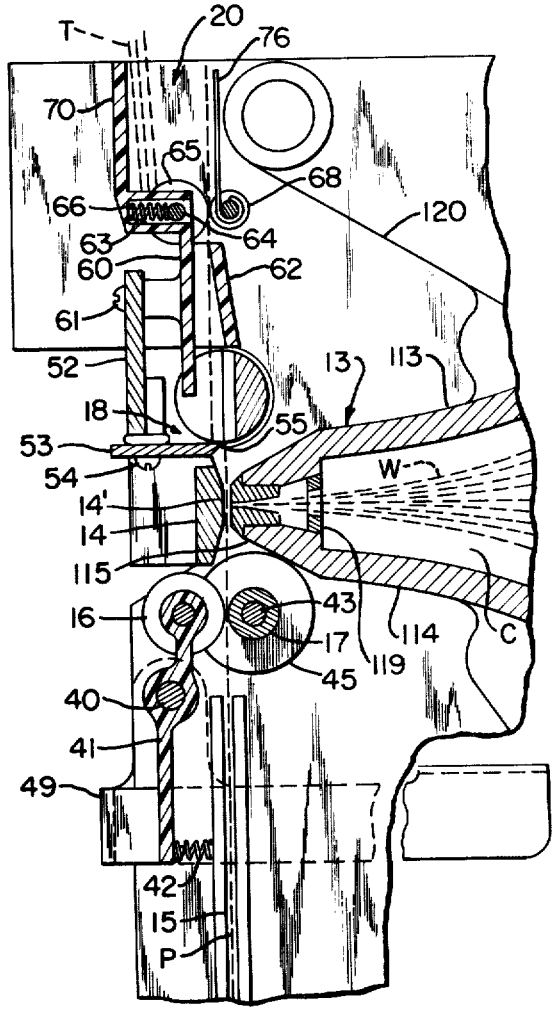
FIG. 3 is a detailed sectional view taken along lines 3—3 of FIG. 2.

As shown in FIGS. 2 and 3, the paper stock P is preferably driven at a constant velocity past the print bar 14 by the pressure roller 16 which is pivotally mounted on a pivot shaft 40 and caused to bear against the surface of the drive capstan 17 by a lever 41 which is spring-loaded as at 42 against the front surface of the paper guide 15. The drive capstan 17 has the ends of its drive shaft 43 journaled in bearings not shown in the frames 12; and a pulley 45 at one end of the drive shaft 43 is driven by a timing belt 46 off of a drive pulley 47 which is keyed to the drive shaft of motor drive 48 to impart rotation through the timing belt to the drive capstan 17, all as shown in FIG. 1. In addition, the pressure roller 16 can be forced away from the drive capstan by a tab or lever 49 which also pivots about the pivot shaft 40 to bear against the lower end of the lever 41 and by inward pressing will overcome the force of the spring 42 to separate the pressure roller from the drive capstan whenever it is desired to temporarily interrupt advancement of the paper stock past the print bar.

Figure 4:
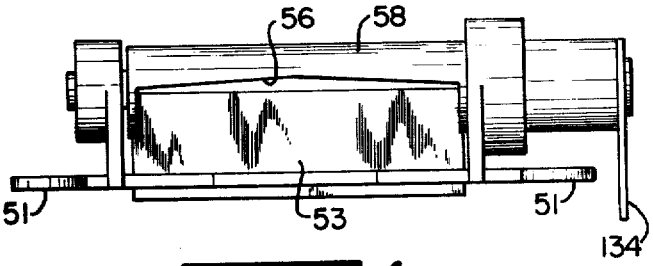
FIG. 4 is a top plan view enlarged of the cutter head of the ticket printer.

The print bar 14 is preferably formed as a unitary part of the capstan which forms the support for the cutter so that the print bar 14 will remain properly aligned with the cutter section notwithstanding repeated impact by the print wires against the print bar surface. The print bar 14 therefore extends horizontally between side flanges 50 which extend along the inner surfaces of the side frames 12 then continue outwardly into laterally projecting ears 51, the latter forming downward continuations of a die casting which defines a vertical mounting plate 52 for cutter bar 53. As best seen from FIG. 3, the cutter bar 53 is affixed to the lower edge of the vertical mounting plate 52 by screws 54 passing upwardly through grommets or flexible washers so that the cutter bar 53 extends rearwardly in a horizontal direction directly above the upper edge of the print bar 14. The rearward beveled edge of the cutter bar 53 defines a stationary cutting edge or blade 55 which is disposed along the path of movement of the paper. A generally V-shaped cutting edge 56 is formed in rotary blade 58 which is caused to rotate about a horizontal axis to shear the blade 58 across the stationary cutting edge 55, as best seen from FIG. 4.

Located directly above the cutter bar 53 and spaced behind the vertical mounting plate 52 is a vertical guide wall 60 which is affixed by mounting screws 61 in spaced parallel relation to the mounting plate 52. An inclined guide wall 62 preferably defines an integral part of the die casting for the mounting plate 52 and print bar 14 and is so disposed as to converge upwardly in closely spaced relation to the vertical guide wall 60 thereby forming a convergent guide path for continued upward vertical movement of the paper P toward the stacking area. A guide plate 70 forms an upward vertical extension of the guide wall 60 and includes a horizontal passage 63 for insertion of a drive shaft 64 for eject rollers 65, and the shaft 64 is spring-loaded by spring 66 to force the eject rollers 65 against capstan drive roller 68. Preferably the stationary guide plate 70 is formed as a unitary extension of the guide wall 60 and housing at the upper extremity of the printer assembly intermediately between the side frame portions. The capstan drive 68 is driven by endless flexible drive belt 72 which is trained over drive pulley 73 at the end of a motor drive shaft or eject motor 74 and a driven pulley 75 which is keyed to the capstan drive shaft 68'. In addition, a ticket deflector plate 76 has its lower end coiled about the capstan drive shaft 68' so as to be spring-loaded in a forward direction toward the upper stationary guide 70 in the stacking area. In this way, as the tickets are advanced through the convergent guide section defined between the mounting plates 60 and 62 into the stacking area they will be shifted by the deflector plate 76 against the stationary guide.

As described, the tickets are formed by severing the leading end of the continuous roll of paper a predetermined number of spaces, or pulses, as determined by the optical switch, after the printing is completed so as to leave a slight margin beneath the last line of print. For instance, the paper may be a relatively heavy stock having a width on the order of two inches. Accordingly, it is highly desirable that the paper be advanced into the printing section with a minimum of friction or drag imposed upon the main drive capstan 17 so as to assure that the paper will be advanced at a continuous, even rate of speed past the print head. To this end, the paper supply roll 22 has a core which is mounted on a spindle 80, the opposite ends of which are inserted into open slots 81 which are aligned in the rearward extension plates 82 of the main frame members 12 so that the paper roll is readily insertable and replaceable from the rear of the assembly. In the loaded position, the outer surface of the roll 22 is contacted by the upper free end 83 of the pivotal arm member 84, the arm being pivotal about a shaft 85 mounted in the frame 12 directly beneath the supply roll 22, and a torsion spring not shown biases the free end 83 against the outer surface of the roll 22. A "low paper" condition is sensed whenever the arm member 84 advances inwardly toward the center or core of the roll 22 a sufficient distance to cause a lateral extension 86 to engage an actuator on limit switch 87 whereby to energize a suitable signal or alarm, not shown, or in the alternative to cut off the power to the various motor drives in the printer apparatus in response to a low paper condition.

The free or leading end of the paper is advanced or drawn from the roll 22 around the guide roller 26 which has a roller shaft 88 journaled in aligned, arcuate slots 89 so as to reduce friction on the paper as it is caused to bend around the roller 26 into the entry guide 28. A stripper motor assembly includes the drive capstan 23 which is driven by stripper motor 23' through drive belt 90 and pulley 91 to frictionally engage the paper as it exits from the entry guide 28. A pressure roll 24 is disposed on the other side of the guide path and is biased against the capstan by a springloaded lever 92.

The loop sensor assembly 30 serves as a movable guide for advancement of the paper into the fixed guides defining the vertical guide path 16. A generally U-shaped rib 29 forms a continuation of the guide path leading away from the drive capstan 23 to form the outside of a guide path extending downwardly then upwardly around the loop sensor assembly into alignment with the outer rib 15' on the fixed vertical guide path 15. A fixed inner guide rib 27 extends for a limited distance away from the drive capstan 23. In the loop sensor assembly, an inner spaced, movable loop guide includes a pair of spaced ribs 93 and 94 interconnected by a common plate 95 which is pivotal about a shaft 96 so as to locate the ribs 93 and 94 in inner spaced relation to opposite sides of the outer guide member. The loop sensor assembly includes a relatively large guide roller 97 which is mounted on the free end of the loop sensor arm 98 so as to be journaled on the pivot shaft 96 for the movable guide as described, the shaft 96 being slidable in slot 99 in the outer side frame members 12. In turn, an inner slot 100 is formed in the slider 32 which is constrained to move in a generally vertical direction along the guide path formed by a series of guide pins 102. The slider 32 includes a cam surface 104 which is movable into engagement with upper and lower switch actuators 105 and 106 on switch members 107 and 108, respectively.

From the relationship described and shown, it will be noted that the guide roller 97 has its outer peripheral surface normally disposed in inner spaced relation to the lower return end of the fixed extension guide 29. However, it is free to move upwardly along with the pivot shaft 96 in advancing through the inner slot 100 formed in the slider 32 so that initially the guide roller 97 will be free to advance upwardly independently of any movement of the slider 32. However, when the shaft 96 reaches the upper edge of the slot in the slider 32, it will then cause the slider to advance along with the guide roller 97 and cause the cam surface 104 on the slider to control opening and closing of the switch actuators 105 and 106. Movement of the guide roller in the manner described is determined by the tension of the paper as it is advanced continuously by the main drive capstan 17.

If there is relatively little tension on the paper, the guide roller will be free to assume the position as shown in FIG. 1 and the cam surface 104 on the slider will be in the position as shown closing the lower switch actuator 106, and the upper switch actuator 105 remaining open. This lower extreme position would serve to indicate that the machine is out of paper or in other words that there is complete absence of tension or upward drawing force on the guide roller in which case it would then break the circuit into the main motor drive for the drive capstan 17. An intermediate position, or a "normal static" position is defined when the guide roller is caused to rise by the paper to a sufficient level to cause the high point on the cam surface to be positioned between the two switch actuators 105 and 106, which position would normally be reached when the paper roll is larger and there is relatively little tension on the paper as it is advanced off the roll 22 by the main drive capstan 17. However, as the tension in the paper increases as a result in reduction of the size of the paper roll, the shaft 96 will continue to rise thereby causing the slider 32 to advance to its uppermost position at which point its cam surface 104 will have depressed the upper switch actuator 105 to energize the stripper motor 23' for the drive capstan 23. The motor 23' is operative to drive its capstan 23 at a speed approximately ten percent faster than the speed of advancement of the drive capstan 17 so that as the two motors are running simultaneously the loop will be restored by virtue of the paper being fed into the loop area faster than it is being drawn out. Initially, the shaft 96 will start to return to its lower position, but friction in the system between the switch actuator 105 and cam surface 104 on the slider 32 will cause the slider to remain in its separate position to keep that switch closed until the shaft 96 engages the lower edge of the slot 100 on the slider causing the cam surface 104 to begin to move away from the upper switch actuator and the stripping motor is shut off.

Figure 5:
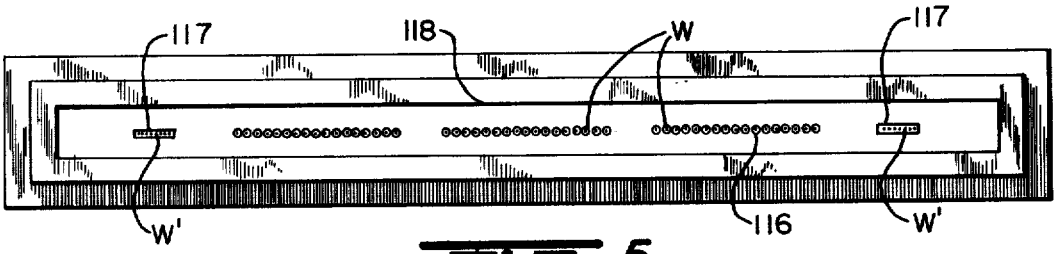
FIG. 5 is a detailed enlarged view of the print head.

In the preferred form of ticket printer as described, most desirably the print wires W are mounted in solenoids arranged in three banks, laterally spaced of one another across a common arcuate mounting plate 110. The mounting plate is disposed at the rearward divergent end of a generally V-shaped frame in which upper and lower sides 113 and 114 of the frame converge forwardly and terminate in a common nose portion 115. As shown in FIG. 5, a series of openings 116 and wider bar code openings 117 are formed in a bearing plate 118 inserted in the nose 115 of the leading edge of the print head frame, and the print wires converge forwardly through individual guide tubes, not shown, which are supported within the cavity of the frame by a potting compound in the cavity as designated C, then pass through a pre-aligner designated at 119. The print wires W and W' are adapted to form impressions on the paper by striking a print ribbon 120 which is advanced along a generally vertical guide path between the guide path of the paper and the front bearing plate 118 of the print head 13. The print ribbon 120 is advanced from a supply spool 122 along an inclined path defined by guide pins 123 then downwardly past the front of the bearing plate 118 and returned across a rearward guide path as defined by the guide pins 124 for rewinding upon a take-up spool 125. A motor drive not shown is provided for driving the take-up spool 125 to advance the print ribbon 120 along the vertical guide path and reverse gearing not shown is provided to drive the supply spool 122 in the event that it is desired to employ a reusable ribbon and to reverse its path of travel from the take-up spool back onto the supply spool.

Figure 6:
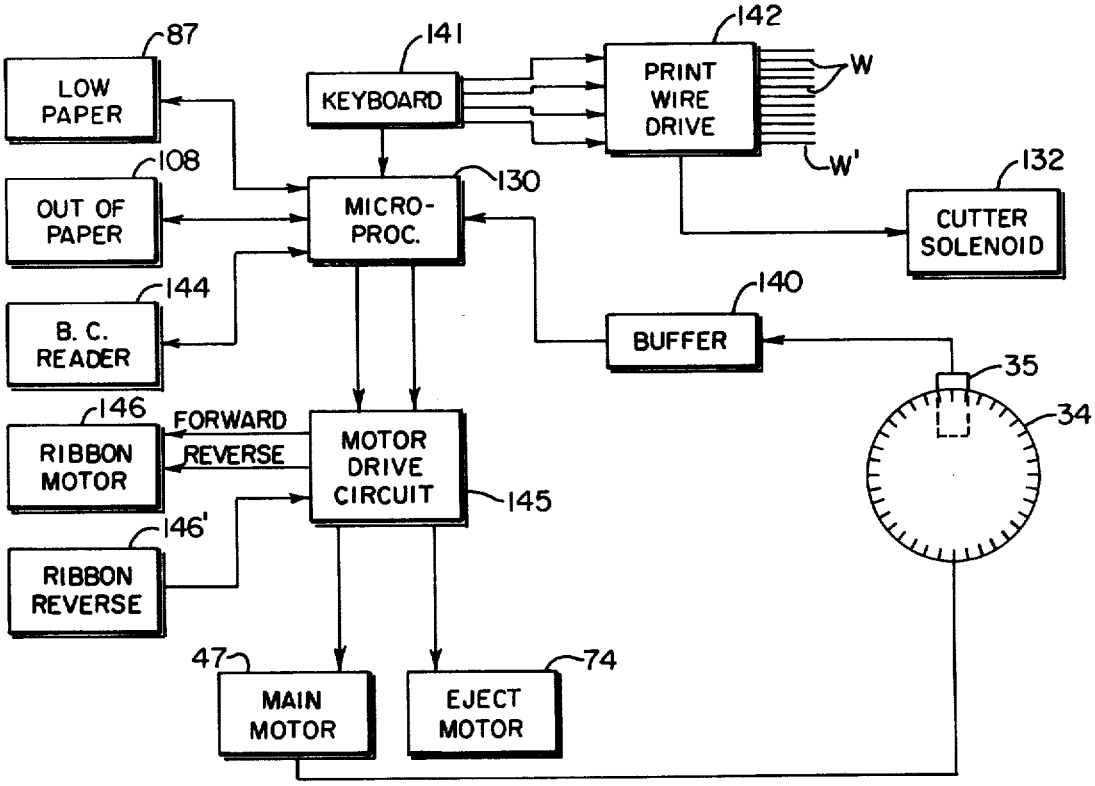
FIG. 6 is a somewhat schematic block diagram of the circuitry employed in accordance with the present invention.
Figure 7:
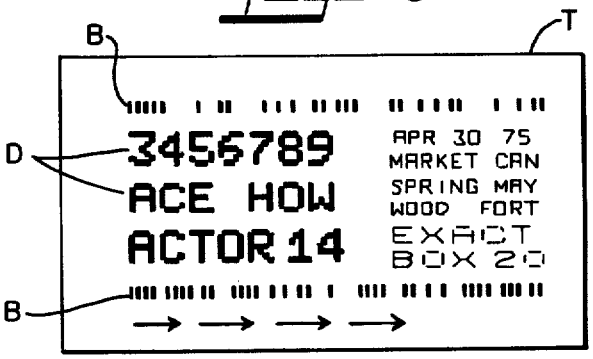
FIG. 7 is a view of a typical ticket in printed form.

As illustrated in FIG. 7, the ticket printer is capable of printing characters or impressions of various different designs and sizes by energizing selective ones of the print wires as the paper is continuously advanced across the print bar. For the purpose of illustration, the strobe disc 34 is designed to generate six pulses through the optical switch 35 for each one-tenth of an inch of paper movement; or in other words, one strobe signal per 0.016" of paper movement. As represented in FIG. 6, each strobe signal generated by the switch 35 is applied through a microprocessor 130 to activate selected solenoids in each bank of solenoids S to impress dots D on each line of the paper, or for every 0.016" of paper movement. For instance, the logic in the microprocessor is designed to conserve electrical power by sequentially firing the banks of solenoids at closely spaced, but staggered, time intervals on the order of 300 microseconds apart. Thus, assuming that the time interval between each strobe signal is 1.6 milliseconds, the firing of selected wires in each bank of solenoids can be sequenced to fire at staggered intervals within the time period between strobe signals so long as the last bank of solenoids has completed its firing ahead of the arrival of the next signal or pulse. The bar codes represented at B in FIG. 7 are not printed as often as the numerical or character dots represented at D; and generally are printed in increments of 0.050 of an inch to provide a bar code on either side of the ticket to provide additional information in coded form on the ticket. A predetermined time interval after the last line has been printed on the paper to comprise the desired information on the ticket, a signal from the microprocessor to the solenoid drive circuit energizes cutter solenoid 132. As seen from a consideration of FIGS. 1, 2 and 4, solenoid 132 drives a plunger 133 to pivot a crank 134 whereby to rotate the cutter blade 58 and sever the paper P.

The strobe signals generated by the strobe disc 34 are applied by the optical switch 35 through buffer electronics represented at 140 which shapes the signals into low logic level signals for application to the microprocessor 130. In response to input signals received from Keyboard 141 in correlation with pulses received from the buffer electronics, the microprocessor applies signals to solenoid drive circuit 142 for the print wire solenoids S to sequentially fire selected solenoids in each bank, as described earlier, as well as to fire the bar code solenoids. A bar code reader 144 is stationed directly above the print head 13 to sense the bar code B printed on the ticket for comparison with information in the microprocessor 130 in order to verify the information printed on each ticket. At the end of the bar code as sensed by the microprocessor, a signal is applied through the solenoid drive circuit 142 to the cutter solenoid 132 in order to activate the cutter and sever the leading end of the paper from the continuous paper roll. A motor drive circuit 145 also receives signals from the microprocessor 130 in order to control activation of the various motor drives specifically including the main motor drive 47 for the drive capstan 17, the eject motor 74 for the ejector capstan 68 and the reversible motor drive 146 for the ribbon spools 122 and 125. In addition, when desired to reverse the ribbon motor drive, a ribbon reverse switch 146' may be actuated by the operator to reverse the direction of advancement of the ribbon across the print head. If desired, and as shown, the low paper sensor switch 87 associated with the paper supply roll 22 may be electrically connected into the microprocessor 130 in order to transmit a signal indicating a low paper condition as described; and similarly, the loop sensor switch 108 may be employed to transmit a signal to the microprocessor to relate that the machine is out of paper whenever the guide roller is permitted to drop to its low position. In the alternative, either or both of the low paper and out paper switches may be utilized to generate a visible signal whenever a low paper or out of paper condition occurs, respectively.

There is illustrated in FIG. 7 a portion of a ticket T which may typically be employed for race track betting operations. Here the information concerning the race is printed in various different sizes of numbers and letters, as represented at D, and the bar code B is formed along opposite margins of the ticket for verification of the information on the ticket as well as to provide additional information if desired. As seen from the configuration of the ticket, printing proceeds line-by-line in a lengthwise direction, as represented by the arrows. For the purpose of illustration and not limitation the tickets may be composed of relatively heavy paper stock on the order of two inches in width and which is fed from a continuous roll 22 on the order of eight inches in diameter. The length of each ticket is dictated according to the space required for the information to be printed and may be varied in length according to the size and amount of information printed. However, it can be appreciated that the method and apparatus employed for printing tickets is readily conformable for use in a number of printing operations, especially where the margins are relatively narrow and it is desirable to print continuously line-by-line through a stationary print head 13 at high rates of speed.

It is therefore to be understood that various changes and modifications may be adopted in the apparatus and method of the present invention with departing from the spirit and scope as defined by the appended claims.

What is claimed is:

1. A wire printing apparatus adaptable for continuously printing tickets and the like on successive portions of a print medium supplied in the form of an elongated continuous roll, comprising in combination:

a print bar, a stationary print head disposed in closely spaced confronting relation to said print bar, said print head containing a plurality of print wires converging forwardly towards said print bar, said print wires terminating in dot-like impression surfaces arranged in a row;

means establishing a guide path for movement of the print medium between said print bar and print head in a direction transversely of the row of print wires;

print medium advancing means for advancing the print medium at a substantially constant rate of speed along the guide path between said print bar and print head including means for sensing the rate of advancement of the print medium along the guide path and generating signals correlated with such rate of advancement;

a guide slot including an arcuate, generally loop-shaped portion through which said print medium is advanced between the supply roll and said print medium advancing means, sensing means for sensing the tension in the paper medium as it is drawn from the supply roll along the guide path by said print medium advancing means, and drive means engageable with the print medium in its movement along the guide path between said supply roll and said loop-shaped portion being energized in response to increasing tension in the print medium as sensed by said sensing means to cooperate with said print medium advancing means in advancing the print medium along the guide path;

means responsive to activation of said print medium advancing means for generating print wire energizing signals correlated with the rate of advancement of the print medium, and means responsive to the signals generated to activate selected print wires in the row of print wires to impress a series of dots to form a line of print on the print medium as the print medium is continuously advanced past the print head; and cutter means for severing each successive portion of the print medium into a separate ticket after selected lines of print have been formed thereon without interrupting advancement of each next successive portion of the print medium past said print head.

2. A wire printing apparatus according to claim 1, said print head being operative to form characters in a direction parallel to the direction of travel of the print medium past the print head.

3. A wire printing apparatus according to claim 2, said print head being operative to form a combination of characters and code designations on the print medium.

4. A wire printing apparatus according to claim 1, said print wires being arranged in a plurality of banks, the print wires being sequentially fired in each bank in succession to form each line of print in response to each signal generated by said signal generating means.

5. A wire printing apparatus according to claim 1, said cutter means including a cutter disposed along the guide path downstream of said print head, and means for energizing said cutter to sever the print medium after completion of printing by said print head, eject means for directing the severed portion of said print medium in a direction away from said print head and cutter.

6. In ticket printing apparatus wherein a print bar is disposed in confronting relation to a print head and a guide path is established for advancement of a length of paper stock from a continuous supply roll betwen the print bar and print head, the combination comprising:

paper drive means stationed in the guide path upstream of said print head for continuously advancing the paper at a predetermined rate of speed along the guide path including means for sensing the rate of advancement of the paper along the guide path and generating signals correlated with such rate of advancement;

a cutter mechanism disposed in the guide path downstream of said print bar including a stationary blade member provided with a cutting edge in proximity and in facing relation to the path of paper travel away from said print head, and a rotary blade including a cutting edge aligned with and in spaced facing relation to the stationary cutting edge, and reciprocal drive means for energizing said rotary blade to shear across said stationary cutting edge whereby to sever the paper on a line normal to its direction of travel without interrupting continuous advancement of said paper past said print head;

tension sensing means for sensing the tension in said paper as it is drawn along said guide path by said paper drive means, and drive means cooperative with said paper drive means when energized in response to increasing tension in said paper as sensed by said tension sensing means to aid in advancing said paper along said guide path; and an ejector mechanism movable into engagement with the paper downstream of said cutter mechanism including roller drive means to advance the paper as it is severed in a direction away from said cutter mechanism, and deflector means for deflecting the paper as it is severed into a discharge area downstream of said ejector mechanism.

7. In a ticket printing apparatus according to claim 6, further including spaced guide members disposed on opposite sides of said guide path between said cutter mechanism and said ejector mechanism, said guide members converging in a direction towards said ejector mechanism.

8. In a ticket printing apparatus according to claim 6, said rotary blade including a generally V-shaped cutting edge in which opposite sides of said cutting edge are slanted at corresponding angles away from a common point of intersection therebetween toward the stationary cutting edge.

9. In a ticket printing apparatus according to claim 6, including an elongated guide slot defining the guide path between the supply roll and paper advancing means, said guide slot including an arcuate generally loop-shaped portion, said drive means including a stripper motor engageable with the paper in its movement through the guide slot between said supply roll and said loop-shaped portion, and said sensing means operative for sensing the tension in the paper as it is drawn from the supply roll along the guide slot by said paper drive means, said tension sensing means including a switch and means yieldably contacting the paper along the loop-shaped portion and responsive to increasing tension in the paper to move in a direction engaging said switch, said switch being activated in response to movement of said yieldable means to activate said stripper motor.

10. In a ticket printing apparatus according to claim 9, said loop sensing means including a slide member, said paper contacting means defined by a roller having means supporting said roller for slidable movement in said slide member, said slide member movable into and out of engagement with said switch in response to movement of said roller.

11. In ticket printing apparatus according to claim 6, said print head containing a plurality of print wires converging forwardly towards said print bar, said print wires terminating in impression surfaces arranged in a row, and means responsive to the signals generated to activate selected print wires in the row of print wires to impress a series of dots to form a line of print on the print medium as it is continuously advanced past the print head.

12. In ticket printing apparatus according to claim 11, said print wires operative to form characters in a direction parallel to the direction of travel of the print medium past the print head and including bar code print wires operative to print coded information simultaneously with the printing of characters on each ticket.

13. In ticket printing apparatus according to claim 12, said print wires being arranged in a plurality of banks, the print wires being sequentially fired in each bank in succession to form each line of print in response to each signal generated by said signal generating means, and means stationed on the guide path for sensing the coded information printed on the print medium.

14. In ticket printing apparatus wherein a print bar is disposed in confronting relation to a print head and a guide path is established for advancement of a length of paper stock from a continuous supply roll between the print bar and print head, the combination comprising:

paper advancing means stationed in the guide path upstream of said print head for continuously advancing the paper at a predetermined rate of speed along the guide path;

an elongated guide slot defining a portion of the guide path for paper movement between the supply roll and paper advancing means, said guide slot including a generally U-shaped portion, a stripper motor including drive means engageable with the paper in its movement through the guide slot between said supply roll and said U-shaped portion, and loop sensing means for sensing the tension in the paper as it is drawn from the supply roll along the guide slot by said paper advancing means, said tension sensing means including a pair of switch members and a slider having a roller yieldably contacting the paper along the U-shaped portion and responsive to increasing tension in the paper to move in a direction causing said slider to engage one of said switch members, one of said switch members being activated in response to movement of said slider to activate said stripper motor, and the other of said switch members being activated in response to absence of paper in said U-shaped portion to generate a "no paper" signal;

a cutter mechanism disposed in the guide path including a stationary blade member provided with a cutting edge in proximity and in facing relation to the path of paper travel, and a rotary blade including a cutting edge normally aligned with and in spaced facing relation to the stationary cutting edge, and reciprocal drive means for reciprocating said rotary blade to advance across said stationary cutting edge whereby to sever the paper on a line normal to its direction of travel and to reverse said rotary blade to its initial position in spaced facing relation to said stationary cutting edge; and an ejector mechanism movable into engagement with the paper downstream of said print head including drive means operative independently of said paper advancing means to advance the paper as it is severed in a direction away from said cutter mechanism into a discharge area downstream of said ejector mechanism.

15. In ticket printing apparatus according to claim 14, said rotary blade including a generally V-shaped cutting edge in which opposite sides of the cutting edge are slanted at corresponding angles away from a common point of intersection therebetween toward the stationary cutting edge, said rotary blade being reciprocal about an axis in spaced parallel relation to said stationary cutting edge.

* * * * *